United States Patent [19]

Hufford et al.

[11] 4,430,634

[45] Feb. 7, 1984

[54] ROTARY POTENTIOMETER WITH MOLDED TERMINAL PACKAGE

[75] Inventors: James N. Hufford, Elkhart, Ind.; John Zdanys, Jr., Edwardsburg, Mich.

[73] Assignee: CTS Corporation, Elkhart, Ind.

[21] Appl. No.: 340,349

[22] Filed: Jan. 18, 1982

[51] Int. Cl.[3] ..... H01C 10/32

[52] U.S. Cl. ..... 338/164; 338/199

[58] Field of Search ..... 338/164, 184, 199, 157, 338/160, 166, 167; 29/610 R

[56] References Cited

U.S. PATENT DOCUMENTS

| | | | |
|---|---|---|---|
| 1,618,967 | 3/1927 | Adams | 338/164 X |
| 3,314,036 | 4/1967 | Kruse | 338/184 X |
| 3,377,606 | 4/1968 | Ferrell | 338/184 X |
| 4,314,229 | 2/1982 | Kawasaki et al. | 338/160 |

*Primary Examiner*—C. L. Albritton

*Attorney, Agent, or Firm*—Larry J. Palguta; John A. Young

[57] ABSTRACT

A rotary potentiometer (10) having an insert molded thermoplastic resin body (12) with an annular groove (14) disposed therein about a central post (19) having an aperture (16) therethrough. A resistive element (26) is disposed about the periphery of the groove (14), an actuator arm (20) is attached to one end of a metallic shaft (18) journalled in said aperture (16) in the central post (19), and a return spring (28) has one end (29) captured within a drop slot (13) at the perimeter of the groove and the other end (31) secured in slot (11) of the shaft (18) for returning the actuator arm (20) and drive arm (22) to their initial position. A drive arm (22) has a rake type contactor (33), the drive arm (22) being secured to the operating end of the shaft (18). A terminal coupling subassembly (65) is positioned within a receiving well (40) in the potentiometer body (12), and is captured within the body by securing a cover (80) over the receiving well (40). The plurality of terminals (60–62) in the coupling subassembly (65) have angled ends (72) for resilient contact with terminations of the resistive element (26) and terminal connection ends (55) molded within the potentiometer body (12).

18 Claims, 4 Drawing Figures

ROTARY POTENTIOMETER WITH MOLDED TERMINAL PACKAGE

DESCRIPTION

1. Technical Field

This invention relates to rotary potentiometers.

2. Background Art

A wide variety of variable resistor and potentiometer constructions are presently available. These constructions utilize well known prior art techniques for the fabrication and assembly of the piece parts. Usually the terminals are fabricated as separate piece parts, and then individually secured to the housing or a portion of the construction, or the terminal piece parts may become part of the housing when the housing is formed by insert molding. There are many methods and structures utilized for assembling the terminals as part of a variable resistor or potentiometer construction. This is illustrated by the following patents: Marsten U.S. Pat. No. 2,240,565 entitled "Volume Control," issued May 6, 1941; Douglas U.S. Pat. No. 3,004,233 entitled "Potentiometer," issued Oct. 10, 1961; Hardison et al. U.S. Pat. No. 3,069,646 entitled "Variable Resistor Device," issued Dec. 18, 1962; Beaver et al. U.S. Pat. No. 3,518,604 entitled "Electrical Component," issued June 30, 1970; Casey et al. U.S. Pat. No. 3,533,042 entitled "Subminiature Trimmer Potentiometer," issued Oct. 6, 1970; and Hildreth et al. U.S. Pat. No. 4,081,782 entitled "Combined Rotary Potentiometer and Switch," issued Mar. 28, 1978.

The development of electronic controls for utilization in the automotive industry has resulted in a demand for devices able to a transduce rotary position to an electrical output received by a microprocessor. Potentiometers are most often utilized to transduce a change in rotational position to an electrical output. In order that a potentiometer construction be useable with an automotive engine, it is often necessary to utilize a thermoplastic resin housing, such a material being resistant to many of the contaminants and corosive materials present about an automotive engine. When utilizing an insert molding process, it is important that the metallic parts be of a standard configuration so that the insert molding process can be completed in one step. Otherwise, if the parts to be integrally molded within the housing are of an irregular shape, this will require more than one insert molding step. Therefore, it is desirable to produce a potentiometer construction useable with an automotive engine, wherein the body is insert molded about standard shaped terminal connections so that the insert molding process may be completed in one step. It is also desirable that this potentiometer construction be comprised of a number of parts which are easily assembled.

DISCLOSURE OF THE INVENTION

The present invention comprises a rotary potentiometer having an insert molded thermoplastic resin housing. Disposed within the housing is an annular groove disposed about a central post having an aperture therethrough. A resistive element is mounted about the outer peripheral wall of the groove, and a metallic shaft is journalled within the aperture in the post, the shaft having an actuator arm connected to the exterior end of the shaft and a drive arm connected to the interior end of the shaft. A cylindrically shaped return spring is mounted within the groove and about the post by having one end received by a drop slot at the outer peripheral wall of the groove, and the other end of the spring received within a slot in the end of the shaft. A rake type contactor is secured to the drive arm for wipable engagement with the flexible resistive element. A terminal subassembly is comprised of three terminals coupled together in an insert molded subassembly package. The potentiometer housing has three identically shaped terminal projections and connectors insert molded within one end of the housing. Each of the ends of the terminals contained in the terminal subassembly package are angled for resilient engagement with a termination of the resistive element at one end and a terminal projection at the other end. The terminal coupling subassembly may be drop-fitted in a receiving well within the potentiometer housing. The terminal coupling subassembly is captured within the potentiometer housing by ultrasonically welding a cover over the terminal receiving well.

BEST MODE FOR CARRYING OUT THE INVENTION

Figure 1:
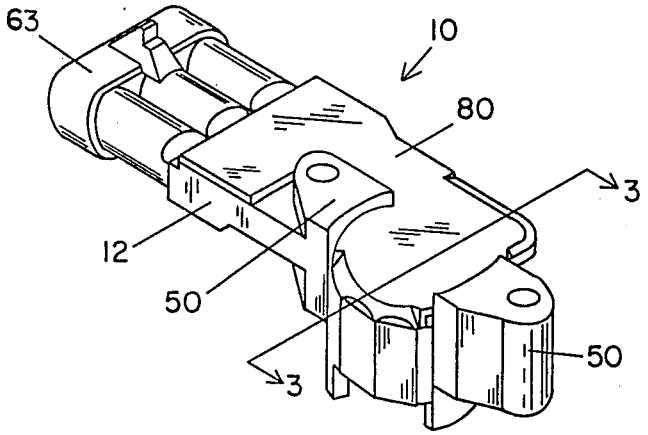
FIG. 1 is an isometric view of the potentiometer of the present invention.
Figure 3:
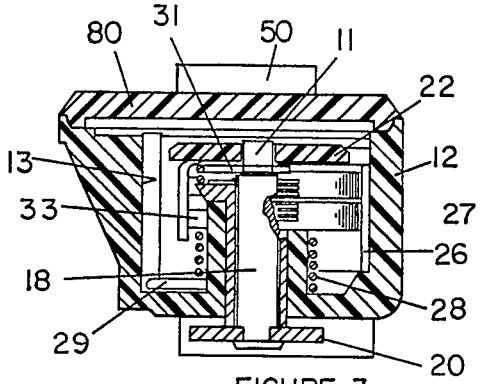
FIG. 3 is a section view taken along view line 3—3 of FIG. 1.
Figure 4:
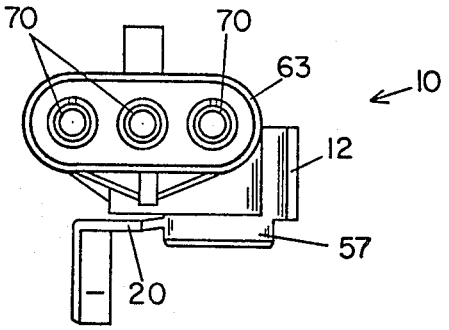
FIG. 4 is an end view take along view line 4—4 of FIG. 2.
Figure 2:
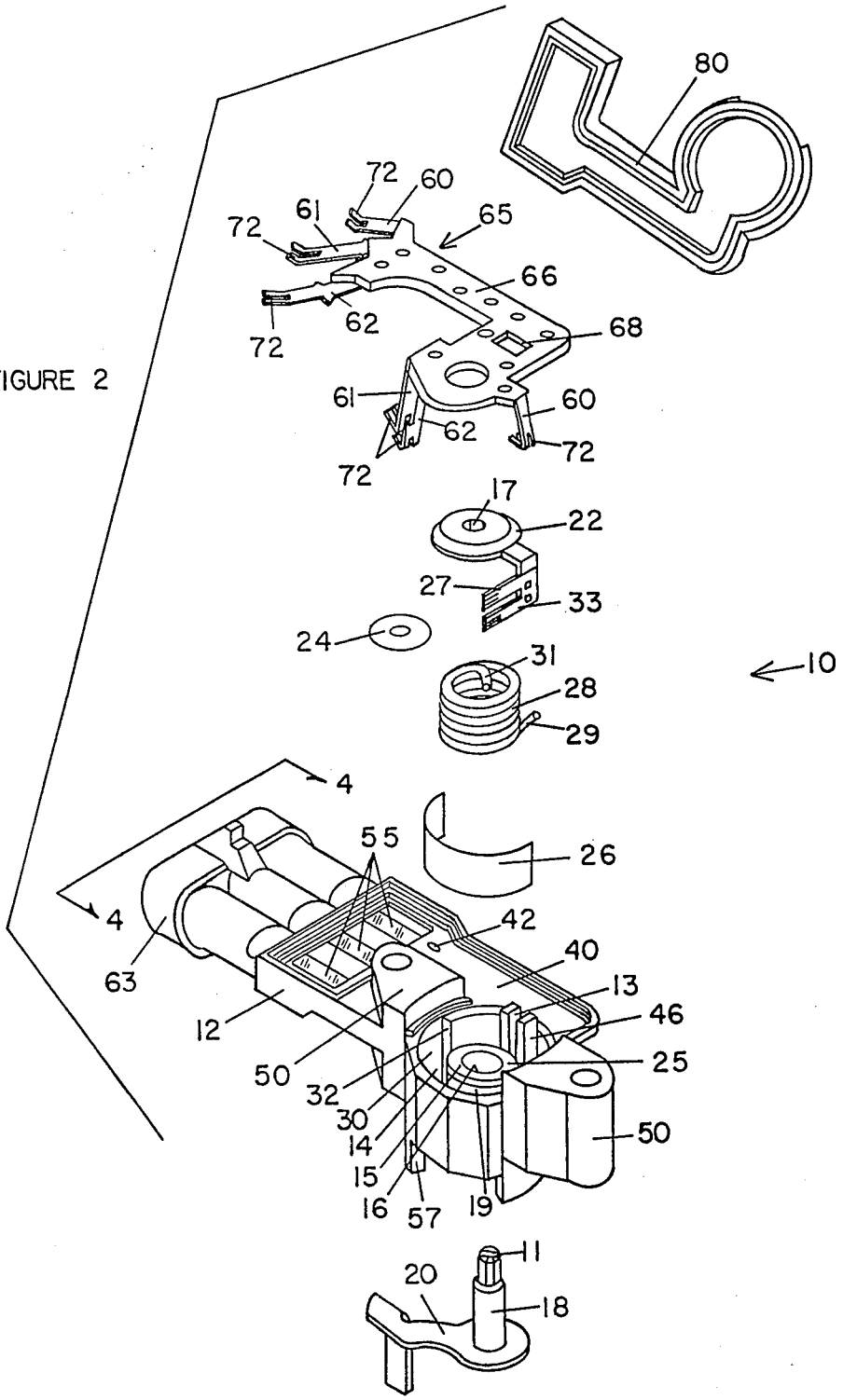
FIG. 2 is an exploded view of the potentiometer.

Referring now to the drawings, the potentiometer of the present invention is designated generally by reference numeral 10. The body 12 is comprised of a thermoplastic resin formed by insert molding techniques well known in the art. Formed within body 12 during the insert molding operation, is a groove 14 disposed about an interior post 19. The interior post 19 has a sintered bronze bushing 15 fitted therein, the bushing 15 having a through aperture 16 located therein. The groove 14 includes exterior peripheral wall 30 having at one end a drop slot 13. The body 12 includes fastening ears 50 for securement of one end of the housing 12, and at the other end of the housing is plug fitting 63 for accepting a plug connection with terminal connections 70. Located within the body 12 is a terminal receiving well or opening 40 and at one end of the receiving well 40 are exposed terminal connection ends 55 of terminal connections 70. Also located within the receiving well 40 is positioning slot or opening 42.

A metal shaft 18 is journalled within the aperture 16, with an exterior actuator arm 20 secured to the exterior end of shaft 18 and a drive arm 22 secured to the interior end of the shaft. A "Kapton ®" film washer 24 is positioned about the interior end of the shaft 18 and rests upon the bushing surface 25.

A resistive element 26 comprises a flexible Kapton ® film having resistive tracks disposed thereon and element 26 is mounted along the peripheral wall 30 of the groove 14. Housing shoulders 32 are disposed at an angle of 20° with the wall 30 so that each end of the flexible film is captured within the corner of a shoulder. A resilient cylindrical spring 28 is located about the post 19. End 29 of the spring 28 protrudes radially outwardly and is captured within the drop slot 13 to fix the position of the spring relative to the body 12. The other end 31 of the spring is fitted within the transverse shaft slot 11, thereby providing a return force when the shaft is rotated via the actuator arm 20.

The slot 17 of the drive arm 22 receives the interior end of the shaft 18 so that the drive arm rotates with the shaft. Affixed to the drive arm is a metallic contactor 33 having a plurality of rake fingers 27, the contactor 33 secured by heat staking. The drive arm 22 is positioned within groove 14 provided by the body 12 so that contactor 33 wipably engages the resistive tracks on the resistance element 26.

In order to complete the electrical circuit across the contactor 33 and resistive tracks of the element strip 26, to the terminal connection ends 55, three terminals 60, 61, and 62 are affixed together in a terminal coupling subassembly 65. The terminals 60–62 are bound together by an insert molded thermoplastic body 66. This enables terminals 60–62 to be simultaneously fitted within the receiving well 40. The terminal coupling subassembly 65 has a downwardly protruding post (not shown) and opening 68, the post being received by well opening 42 of well 40, and the opening 68 receiving the protruding posts 46 forming the top portion of drop slot 13, and thereby position the subassembly 65 within the well 40. The terminals 60–62 each have angled ends 72 designed for resilient contact with either a terminal end 55 or a resistive track on the element strip 26. Thus, the entire coupling assembly 65 may be simply drop fitted into the receiving well 40 and thereby complete the circuit connections between the contactor 33, resistive element 26, and the terminal ends 55. The terminal coupling subassembly 65 is captured within the body 12 by securing a cover 80 over the receiving well 40. The cover 80 may be secured by any suitable adhesive, but preferably secured by ultrasonic welding.

OPERATION

The potentiometer 10 is assembled by inserting the resistive element 26 along the peripheral wall 30 of the groove 19, the ends of the element 26 being secured by the angled shoulders 32. The actuator arm 20 is affixed to the exterior end of shaft 18, and the shaft journalled within aperture 16. The return spring 28 is fitted about the post 19, with end 29 being captured by slot 13, and end 31 being secured within transverse shaft slot 11. The washer 24 is mounted over the interior end of the shaft 18 prior to the positioning of spring end 31 within the slot 11.

Contactor 33 is mounted on the drive arm 22 by heat staking methods well known in the art, and the drive arm then secured to the interior end of the shaft 18. The shaft 18 may be rotated by angular displacement of the actuator arm 20, and the shaft will be returned to its initial position by the return spring when the displacement force upon the actuator is released. A body housing stop 57 positions the actuator arm 20 and shaft in their initial position. Assembly is completed by fitting the terminal coupling subassembly 65 within the well 40 so that the downwardly protruding (not shown) post is received by the well opening 42 and the opening 68 receives the posts 46. The terminal coupling subassembly 65 is captured and secured within the potentiometer housing by ultrasonically welding the cover 80 over the receiving well 40.

Rotation of the actuator arm 20 rotates the shaft 18 and effects wipable engagement of the contactor rake fingers 27 with the resistive tracks on the element 26. The electrical circuit of the potentiometer is completed through the terminals 60–62 whose respective angled ends 72 engage termination of the resistive tracks and terminal ends 55.

The flexible resistive element 26 can be readily mounted upon the exterior wall 30 of the groove 14. Because the terminal coupling subassembly 65 allows for the drop-in fitting of a plurality of differently shaped terminals into the potentiometer housing, three identically shaped terminal connections are insert molded in a single step. Thus, the housing is formed in one insert molding step rather than several which would be required if the terminals 60–62 were not shaped the same. The angled ends 72 of the terminals 60–62 are designed specifically for resilient engagement with either respective terminal ends 55 or terminations of a resistive element 26. The potentiometer of the present invention enables the fabrication of piece parts and the assembly of those parts in a minimal number of steps, and produces a potentiometer suitable for use in an automobile engine environment where there are corrosives and contaminants present about the engine. The potentiometer is attached via the fastening ears 50, and the plug fitting 63 receives a plug attachment to electrically communicate the unit with a microprocessor.

INDUSTRIAL APPLICATION

The potentiometer of the present invention may be utilized in automotive applications.

CONCLUSION

Although the present invention has been illustrated and described in connection with example embodiments, it will be understood that this is illustrative of the invention, and it is by no means restrictive thereof. It is reasonably to be expected that those skilled in the art can make numerous revisions and additions to the invention and it is intended that such revisions and additions will be included within the scope of the following claims as equivalents of the invention.

We claim:

1. In combination, a potentiometer comprising a housing having terminal receiving means and means forming a groove disposed about a post having an aperture therethrough, a shaft journalled in said aperture and having actuation means attached thereto, resilient means operatively secured to the shaft, resistive element means disposed within said groove, drive arm means secured to said shaft, contactor means fixedly secured to said drive arm means and positioned for wipable engagement with said resistive element means, and a terminal coupling subassembly comprising a plurality of terminals secured together in an integral subassembly fittable within said terminal receiving means and for connecting said potentiometer with external circuit means.

2. The potentiometer in accordance with claim 1, further comprising cover means enclosing said terminal receiving means and retaining said terminal coupling subassembly within said terminal receiving means.

3. The potentiometer in accordance with claim 2, wherein said cover means is ultrasonically welded to said housing.

4. The potentiometer in accordance with claim 1, wherein said resistive element means comprises a plurality of resistive element tracks disposed on a substrate mounted in said groove means.

5. The potentiometer in accordance with claim 1, wherein said contactor means comprises a metallic contactor having a plurality of rake fingers slideably engaging said resistive element means.

6. The potentiometer in accordance with claim 1, wherein said plurality of terminals have respectively angled ends for resilient engagement with said resistive element means.

7. The potentiometer in accordance with claim 1, further comprising a plurality of terminal connections disposed within said housing, and each terminal of said plurality of terminals includes an angled end at each end thereof for resilient engagement with a respective terminal connection and said resistive element means.

8. The potentiometer in accordance with claim 1, wherein said terminal coupling subassembly comprises a plurality of metallic terminal elements insert molded together into a subassembly for drop-in placement within said terminal receiving means.

9. The potentiometer in accordance with claim 1, wherein said housing comprises an insert-molded thermoplastic resin body having a plurality of terminal connections disposed therein for connection to respective terminals of said terminal coupling subassembly.

10. The potentiometer in accordance with claim 1, further comprising stop means for engaging said actuation means and limiting angular displacement of said shaft.

11. A process for transducing an angular displacement to an electrical output by means of a potentiometer, comprising the steps of: aligning within a potentiometer housing a plurality of terminals contained in an integral subassembly and said plurality of terminals each having an angled end at an end of a respective terminal for engaging a resistance element means at one end and one of a plurality of terminal connections at the other end thereof, positioning shaft means, resilient means, drive arm means, and a contactor means attached to said drive arm means within said potentiometer housing whereby said contactor means is positioned for wipable engagement with said resistive element means, and adjusting the angular position of said shaft means to rotate said drive arm and effect wipable engagement of said contactor means with said resistive element means to effect an electrical output through said plurality of terminals and said terminal connection means.

12. The process in accordance with claim 11, including the steps of fixedly positioning an end of said resilient means in said potentiometer housing and securing the other end of said resilient means to said shaft means.

13. The process in accordance with claim 11, including the step of securing a cover to said potentiometer housing in order to enclose said integral subassembly and capture said subassembly in said housing.

14. The process in accordance with accordance with claim 13, wherein the step of securing said cover to said potentiometer housing is accomplished by ultrasonic welding.

15. The process in accordance with claim 11, including the step of insert molding a thermoplastic resin about the plurality of terminals in order to fixedly position said terminals relatively to one another, thereby producing the integral subassembly for drop-in fitting within said potentiometer housing.

16. The process in accordance with claim 11, further comprising the step of capturing said integral subassembly within terminal receiving means in said potentiometer housing by fitting said subassembly within said terminal receiving means and securing a cover over said terminal receiving means.

17. A process for producing a potentiometer having a drop-in terminal coupling subassembly, comprising the steps of: (1) forming a potentiometer housing having a groove disposed therein, (2) disposing a resistive element means within said groove, (3) inserting the interior end of a shaft means centrally of said groove, (4) securing resilient means to said housing and securing the other end to said shaft means, (5) positioning drive arm means about the interior end of said shaft means, said drive arm means having a contactor means, (6) integrally forming an electrically neutral material about a plurality of terminals to form said terminal coupling subassembly, and (7) positioning said terminal coupling subassembly in terminal receiving means within said housing such that an angled end of each terminal engages said resistive element means and the other end of each terminal is positioned for connection to an exterior circuit whereby angular displacement of said shaft means rotates said drive arm means and contactor means to effect wipable engagement of said contactor means with said resistive element means to effect an electrical output through said plurality of terminals.

18. The process in accordance with claim 17, further comprising the step of securing a cover to said potentiometer housing to capture said terminal coupling subassembly within said terminal receiving means.

* * * * *